US007460071B2

(12) United States Patent
Manholm et al.

(10) Patent No.: US 7,460,071 B2
(45) Date of Patent: Dec. 2, 2008

(54) TRIPLE POLARIZED PATCH ANTENNA

(75) Inventors: Lars Manholm, Gothenburg (SE); Fredrik Harrysson, Gothenburg (SE)

(73) Assignee: Telefonaktiebolaget L M Ericsson (PUBL), Stockholm (SE)

( * ) Notice: Subject to any disclaimer, the term of this patent is extended or adjusted under 35 U.S.C. 154(b) by 0 days.

(21) Appl. No.: 11/722,913

(22) PCT Filed: Dec. 27, 2004

(86) PCT No.: PCT/SE2004/002013

§ 371 (c)(1),
(2), (4) Date: Jun. 27, 2007

(87) PCT Pub. No.: WO2006/071141

PCT Pub. Date: Jul. 6, 2006

(65) Prior Publication Data

US 2008/0100530 A1 May 1, 2008

(51) Int. Cl.
*H01Q 1/38* (2006.01)

(52) U.S. Cl. ..... 343/700 MS; 343/853

(58) Field of Classification Search ..... 343/700 MS, 343/853, 873

See application file for complete search history.

(56) References Cited

U.S. PATENT DOCUMENTS 6,288,682 B1 * 9/2001 Thiel et al. ..... 343/702
6,351,240 B1 * 2/2002 Karimullah et al. ... 343/700 MS
2002/0014995 A1 2/2002 Roberts

FOREIGN PATENT DOCUMENTS

WO WO-A-00/13260 3/2000

* cited by examiner

*Primary Examiner*—Tan Ho

(57) ABSTRACT

An antenna arrangement for a Multiple Input Multiple Output (MIMO) radio system, the antenna arrangement transmitting and receiving in three essentially uncorrelated polarizations. The arrangement includes first and second patches, and four feeding points for feeding the first patch. In one mode of operation, the feeding points are fed in phase with each other, resulting in a first constant E-field in a slot between the edges of the patches. In a second operating mode, the first and second feeding points are fed 180 degrees out of phase with each other, resulting in a second E-field in the slot having a first sinusoidal variation. In a third operating mode, the third and fourth feeding points are fed 180 degrees out of phase with each other, resulting in a third E-field in the slot having a second sinusoidal variation uncorrelated with the first sinusoidal variation.

10 Claims, 3 Drawing Sheets

TRIPLE POLARIZED PATCH ANTENNA

TECHNICAL FIELD

The present invention relates to an antenna arrangement comprising a first and a second patch, each patch being made in a conducting material and having a first and a second main surface, which patches are placed one above the other with the first patch at the top, such that all of said main surfaces are essentially parallel to each other, in which antenna arrangement the first patch has a first edge and the second patch has a second edge, where furthermore the antenna arrangement comprises a feeding arrangement, which feeding arrangement comprises a first, second, third and fourth feeding point, said feeding points being arranged for feeding the second patch, in transmission as well as in reception, each positioned at a distance from a first imagined line passing the patches essentially perpendicular to the respective first and second main surfaces, where a second and third imagined line passes perpendicular to, and intersects, the first line, and where the second line also intersects the first and second feeding points, and where the third line also intersects the third and fourth feeding points, the second and third line presenting an angle $\alpha$ between each other, the angle $\alpha$ being essentially 90°, such that the clockwise order of the succeeding feeding points is the first, the third, the second, and the fourth.

BACKGROUND ART

The demand for wireless communication systems has grown steadily, and is still growing, and a number of technological advancement steps have been taken during this growth. In order to acquire increased system capacity for wireless systems by employing uncorrelated propagation paths, MIMO (Multiple Input Multiple Output) systems have been considered to constitute a preferred technology for improving the capacity. MIMO employs a number of separate independent signal paths, for example by means of several transmitting and receiving antennas. The desired result is to have a number of uncorrelated antenna ports for receiving as well as transmitting.

For MIMO it is desired to estimate the channel and continuously update this estimation. This updating may be performed by means of continuously transmitting so-called pilot signals in a previously known manner. The estimation of the channel results in a channel matrix. If a number of transmitting antennas Tx transmit signals, constituting a transmitted signal vector, towards a number of receiving antennas Rx, all Tx signals are summated in each one of the Rx antennas, and by means of linear combination, a received signal vector is formed. By multiplying the received signal vector with the inverted channel matrix, the channel is compensated for and the original information is acquired, i.e. if the exact channel matrix is known, it is possible to acquire the exact transmitted signal vector. The channel matrix thus acts as a coupling between the antenna ports of the Tx and Rx antennas, respectively. These matrixes are of the size M×N, where M is the number of inputs (antenna ports) of the Tx antenna and N is the number of outputs (antenna ports) of the Rx antenna. This is previously known for the skilled person in the MIMO system field.

In order for a MIMO system to function efficiently, uncorrelated, or at least essentially uncorrelated, transmitted signals are required. The meaning of the term "uncorrelated signals" in this context is that the radiation patterns are essentially orthogonal. This is made possible for one antenna if that antenna is made for receiving and transmitting in at least two orthogonal polarizations. If more than two orthogonal polarizations are to be utilized for one antenna, it is necessary that it is used in a so-called rich scattering environment having a plurality of independent propagation paths, since it otherwise is not possible to have benefit from more than two orthogonal polarizations. A rich scattering environment is considered to occur when many electromagnetic waves coincide at a single point in space. Therefore, in a rich scattering environment, more than two orthogonal polarizations can be utilized since the plurality of independent propagation paths enables all the degrees of freedom of the antenna to be utilized.

Antennas for MIMO systems may utilize spatial separation, i.e. physical separation, in order to achieve low correlation between the received signals at the antenna ports. This, however, results in big arrays that are unsuitable for e.g. hand-held terminals. One other way to achieve uncorrelated signals is by means of polarization separation, i.e. generally sending and receiving signals with orthogonal polarizations.

It has then been suggested to use three orthogonal dipoles for a MIMO antenna with three ports, but such an antenna is complicated to manufacture and requires a lot of space when used at higher frequencies, such as those used for the MIMO system (about 2 GHz). Up to six ports have been conceived, as disclosed in the published application US 2002/0190908, but the crossed dipole and the accompanying loop element is still a complicated structure that is difficult to accomplish for higher frequencies to a reasonable cost.

The objective problem that is solved by the present invention is to provide an antenna arrangement suitable for a MIMO system, which antenna arrangement is capable of sending and receiving in three essentially uncorrelated polarizations. The antenna arrangement should further be made in a thin structure to a low cost, and still be suitable for higher frequencies, such as those used in the MIMO system.

DISCLOSURE OF THE INVENTION

This objective problem is solved by means of an antenna arrangement according to the introduction, which antenna arrangement further is characterized in that, in a first mode of operation, each one of the feeding points are fed essentially in phase with each other, resulting in a first constant E-field being obtained in a slot created between the first and second edges, which first E-field further is directed between said edges, and, in a second mode of operation, the first and the second feeding points being fed essentially 180° out of phase with each other, resulting in a second E-field in the slot, which second E-field further is directed between said edges and has a sinusoidal variation along the slot, and, in a third mode of operation, the third and the fourth feeding points being fed essentially 180° out of phase with each other, resulting in a third E-field in the slot, which third E-field further is directed between said edges, and has a sinusoidal variation along the slot.

Preferred embodiments are disclosed in the dependent claims.

Several advantages are achieved by means of the present invention, for example:

- A low-cost triple polarized antenna arrangement is obtained.
- A triple polarized antenna made in planar technique is made possible, avoiding space consuming antenna arrangements.
- A triple polarized antenna which is easy to manufacture is obtained.

BRIEF DESCRIPTION OF THE DRAWINGS

The present invention will now be described more in detail with reference to the appended drawings, where.

PREFERRED EMBODIMENTS

According to the present invention, a so-called triple-mode antenna arrangement is provided. The triple-mode antenna arrangement is designed for transmitting three essentially orthogonal radiation patterns.

Figure 1A:
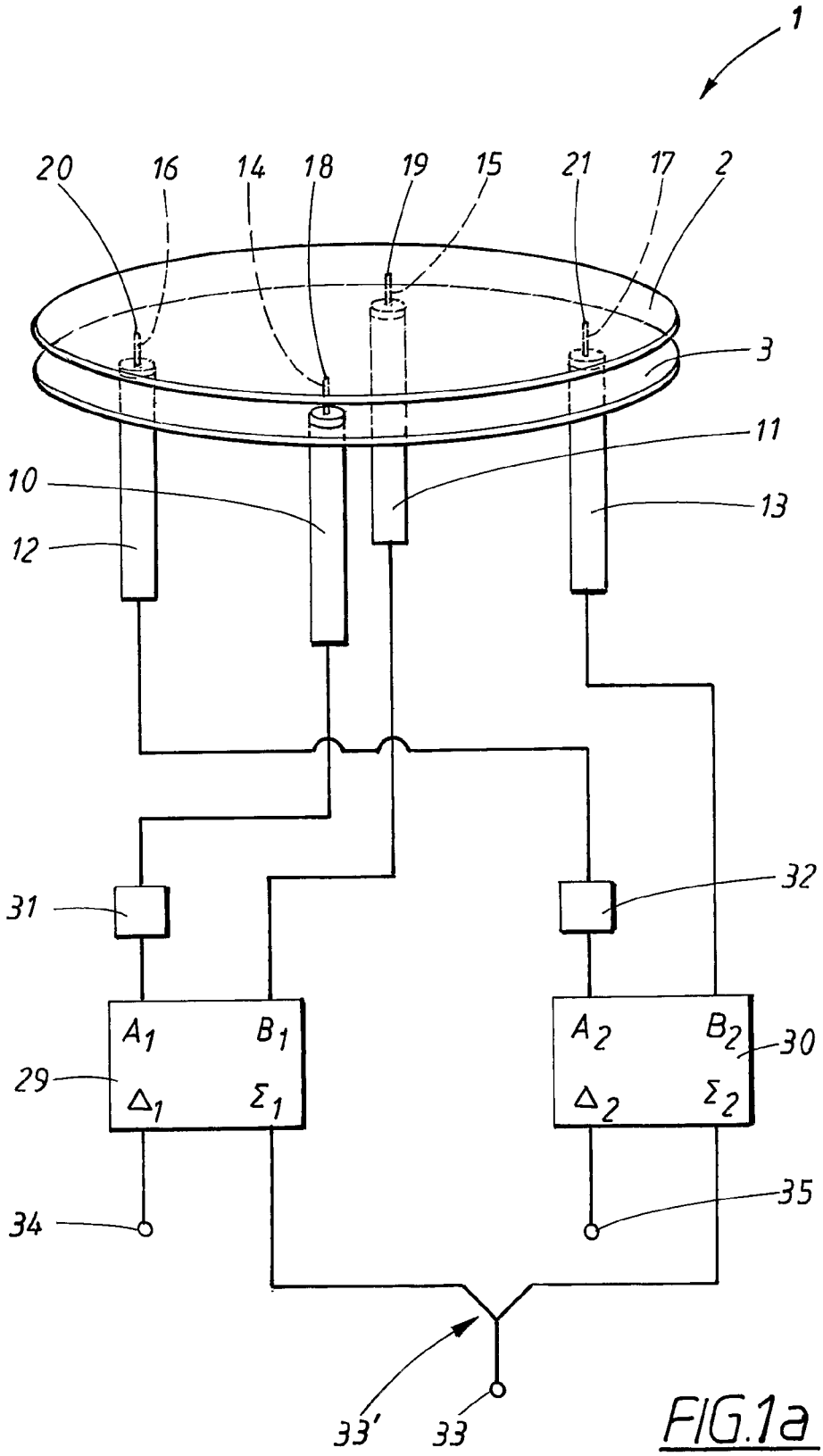
FIG. 1*a* shows a schematic simplified perspective view of a first embodiment of the antenna arrangement according to the invention.
Figure 1B:
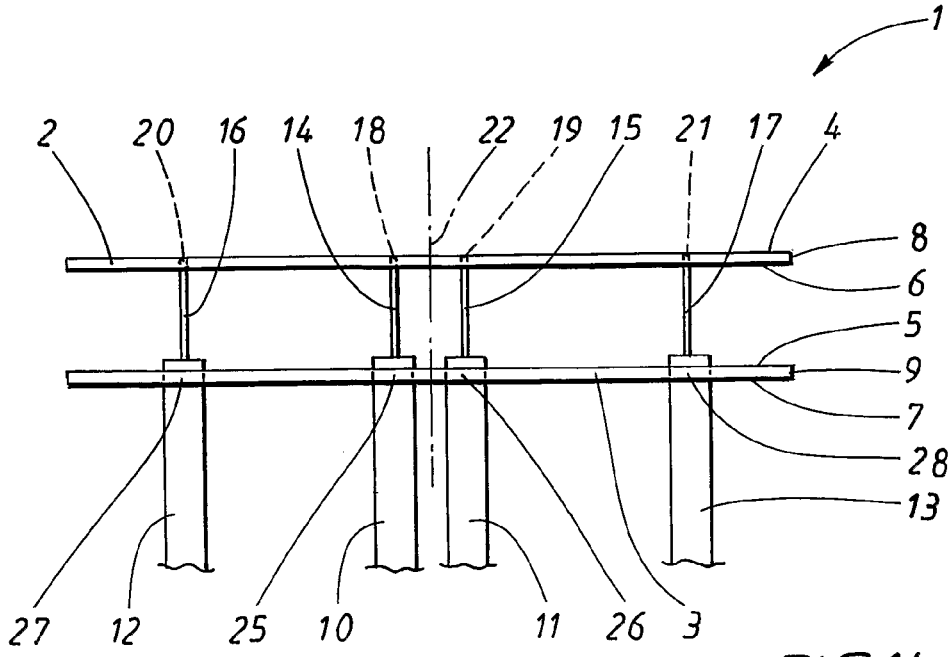
FIG. 1*b* shows a schematic side view of a first embodiment of the antenna arrangement according to the invention.

As shown in FIGS. 1*a-b,* illustrating a first embodiment of the present invention, a triple-mode antenna arrangement 1 comprises a first 2 and second 3 patch. Each patch 2, 3, is relatively thin, having a centre point, and a first 4, 5 and a second 6, 7 main surface, which first and second main surfaces 4, 5; 6, 7 are essentially parallel to each other. The patches 2, 3 are made in a conducting material, such as copper. The patches 2, 3 are preferably round in shape and placed one above the other with the first patch 2 at the top. The patches 2, 3 also have corresponding first and second edges 8, 9.

The triple-mode mode antenna arrangement 1 further comprises a first 10, second 11, third 12, and fourth 13 coaxial feed line, having a first 14, second 15, third 16, and fourth 17 centre conductor, respectively.

Figure 1C:
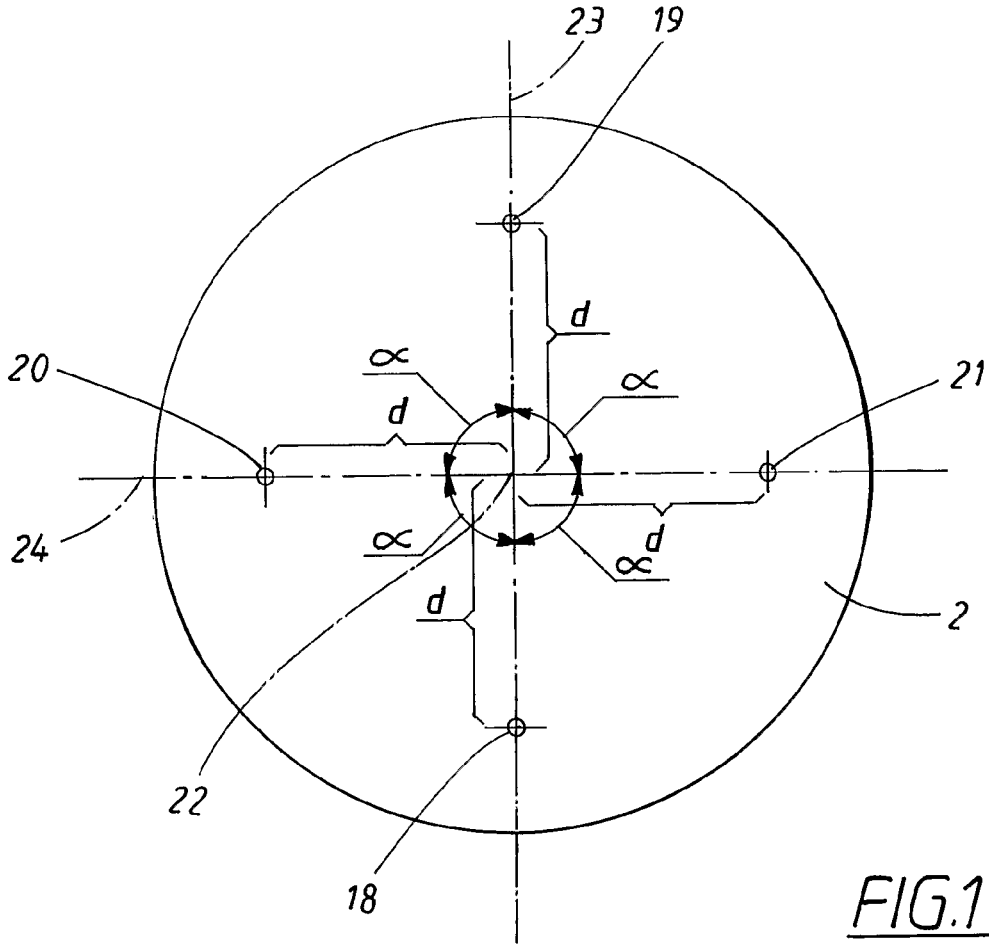
FIG. 1*c* shows a schematic top view of a first embodiment of the antenna arrangement according to the invention.

The first 14, second 15, third 16, and fourth 17 centre conductor each makes electrical contact with the first patch 2 in its outer area, there constituting a first 18, second 19, third 20 and fourth 21 feeding point. Also with reference to FIG. 1*c,* the first 18, second 19, third 20 and fourth 21 feeding points are positioned at an appropriate distance d from a first imagined line 22 passing through the centre of the patches 2, 3, essentially perpendicular to the main planes 4, 5; 6, 7. The distance d is preferably essentially the same for the first 18, second 19, third 20 and fourth 21 feeding points.

A second 23 and third 24 imagined line passes perpendicular to the first imagined line 24 and each intersect the first 18, second 19, third 20 and fourth 21 feeding points, presenting an angle $\alpha$ between each other. This is a way to define the angle $\alpha$ between feeding points, the angle $\alpha$ is essentially 90°. The defining of an angle between feeding points in the above manner is referred to as an angular displacement further in the text. The imagined lines 22, 23, 24 are inserted for explanatory reasons only, and are not part of the real device 1.

There is thus an angular displacement of essentially 90° between the succeeding feeding points 18, 20, 19, 21 all the way around the circumference of a circle with the radius d. The succeeding feeding points 19, 21, 18, 20 are then positioned in such a way that the first 18 and second 19 feeding points are opposite each other with the first imagined line 22 positioned between them, and the third 20 and fourth 21 feeding points are opposite each other with the first imagined line 22 positioned between them, the clockwise order of the succeeding feeding points being the first 18, the third 20, the second 19, and the fourth 21.

The feeding coaxial lines 10, 11, 12, 13 with their centre conductors 14, 15, 16, 17 are part of a feeding arrangement.

The first 14, second 15, third 16 and fourth 17 center conductors make no electrical contact with the second patch 2, and mainly extend perpendicular to the main surfaces 4, 5, 6, 7 of the patches 2, 3. The first 10, second 11, third 12 and fourth 13 coaxial feed lines pass through the outer area of the second patch 3 by means of holes 25, 26, 27, 28 made into the second patch.

The electrical contact between the first patch 2 and the belonging centre conductors 14, 15, 16, 17 at the corresponding feeding points 18, 19, 20, 21 is for example obtained by means of soldering.

With reference to FIG. 1*a,* the feeding arrangement further comprises a first 29 and a second 30 four-port 90° 3 dB hybrid junction and a first 31 and second 32 90° phase-shifter. Each four-port 90° 3 dB hybrid junction 29, 30 has four terminals, A, B, $\Sigma$ and $\Delta$. If the $\Delta$ terminal is connected to its characteristic impedance, an input signal at the $\Sigma$ terminal is divided into two signals at the A and B terminal, each signal having the same amplitude with the phase at the A terminal shifted −90°. If, on the other hand, the $\Sigma$ terminal is connected to its characteristic impedance, an input signal at the $\Delta$ terminal is divided into two signals at the A and B terminal, each signal having the same amplitude with the phase at the A terminal shifted +90°. The function is reciprocal. For reasons of clarity, the first 29 and a second 30 four-port 90° 3 dB hybrid junction and the first 31 and second 32 90° phase-shifter are only shown in FIG. 1*a*.

The first four-port 90° 3 dB hybrid junction 29 comprises a difference terminal $\Delta_1$, a sum terminal $\Sigma_1$ and two signal terminals $A_1$ and $B_1$. Further, the second four-port 90° 3 dB hybrid junction 30 comprises a difference terminal $\Delta_2$, a sum terminal $\Sigma_2$ and two signal terminals $A_2$ and $B_2$. The sum terminals $\Sigma_1$ and $\Sigma_2$ are connected to a common sum signal port 33 at a sum connection point 33'. The difference terminals $\Delta_1$, $\Delta_2$ are connected to a first 34 and second 35 difference port, respectively.

Further, as shown schematically in FIG. 1*a,* the coaxial feed lines 10, 11, 12, 13 of the feeding network leading from the first 29 and second 30 90° 3 dB hybrid junctions, which coaxial feed lines 10, 11, 12, 13 are of equal lengths excluding the first 31 and second 32 phase shifters, feed the first patch 2 at the four feeding points 18, 19, 20, 21. The signal terminal $A_1$ is connected to the first feeding point 18 by means of the first coaxial feed line 10, via the first phase shifter 31, and the signal terminal $A_2$ is connected to the third feeding point 20 by means of the third coaxial feed line 12 via the second phase shifter 32. Further, the signal terminal $B_1$ is connected to the second feeding point 19 by means of the second coaxial feed line 11 and the signal terminal $B_2$ is connected to the fourth feeding point 21 by means of the fourth coaxial feed line 13.

By means of the feeding arrangement, the patches 2, 3 may be excited in three different ways, in a first, second and third mode of operation, enabling three orthogonal radiation patterns to be transmitted.

At all modes of operation described below, the second patch 3 then acts as a ground plane for the first patch 2.

For the first mode of operation, the sum signal port 33 is fed with a signal to the sum connection point 33', which signal first is divided equally, and further fed in the same phase to the respective sum port $\Sigma_1$ and $\Sigma_2$ of the 90° 3 dB hybrid junctions 29, 30. The 90° 3 dB hybrid junctions 29, 30 then divide the respective input signal in equal portions, which are output at the respective signal terminal $A_1$ and $B_1$ and $A_2$ and $B_2$, respectively, with the signals at the terminals $A_1$ and $A_2$ shifted −90°. The signals from $A_1$ and $A_2$ are fed through the respective 90° phase shifter 31, 32, which may be a discrete component or an adjustment of the coaxial feed line length corresponding to 90°. This means that after the respective phase shifter 31, 32, the signal from the terminals $A_1$ and $A_2$ are shifted +90°, resulting in a total phase shift of −90°+90°=0°. All four feeding points 18, 19, 20, 21 are thus fed in phase.

Figure 2A:
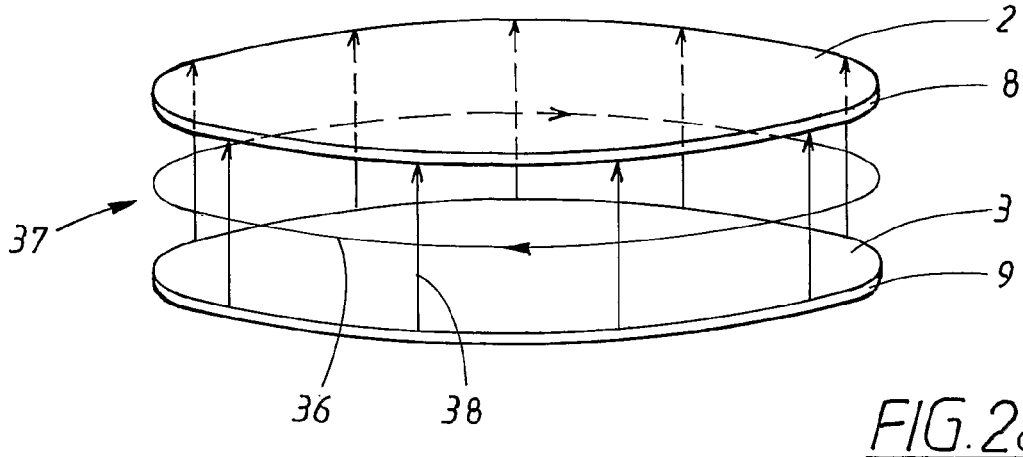
FIG. 2*a* shows a schematic simplified side view of the field distribution at the patches of the antenna arrangement according to the invention at a first mode of operation.

Also with reference to FIG. 2*a*, which for reasons of clarity shows the patches without the feeding arrangement, as the outputs from the signal terminals $B_1$ and $B_2$ are not phase shifted at all, this results in a constant magnetic current loop 36 running in a circumferential slot 37 created between the edges 8, 9 of the first and second 3 patch, respectively.

This magnetic current 36 corresponds to a first E-field 38, all around the circumference of the first 2 and second 3 patch, which first E-field 31 is constant and directed essentially perpendicular to the main surfaces 4, 5; 6, 7 of the first 2 and second 3 patch in the slot 37. In FIG. 2*a*, this is shown with a number of arrows.

For the second mode of operation, with reference to FIG. 1*a*, a signal is fed to the first difference terminal $\Delta_1$ of the first 90° 3 dB hybrid junction 29 via the first difference port 34. The first 90° 3 dB hybrid junction 29 then divides the input signal in equal portions, which are output at the respective signal terminal $A_1$ and $B_1$, with the signal at the terminal $A_1$ shifted +90°. The signal from $A_1$ is then fed through the first 90° phase shifter 31. This means that after the first phase shifter 31, the signal from the terminal $A_1$ is shifted +90°, resulting in a total phase shift of 90°+90°=180°.

Figure 2B:
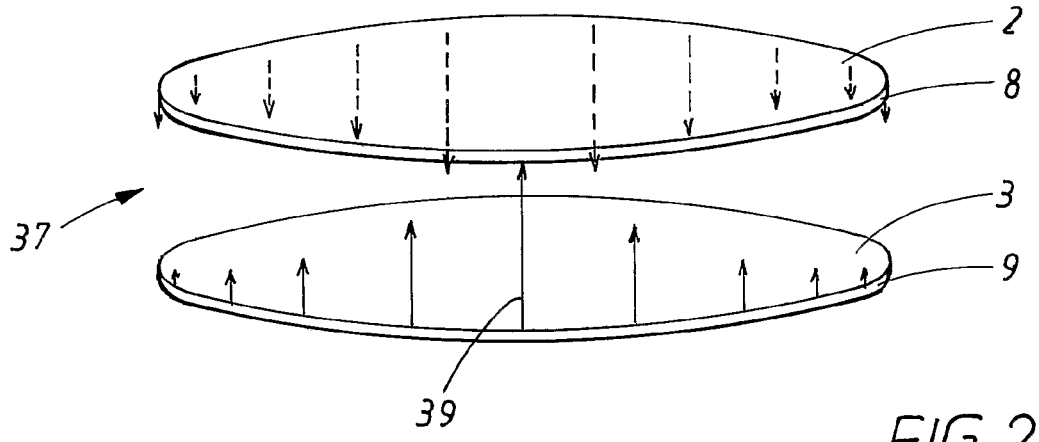
FIG. 2*b* shows a schematic simplified side view of the field distribution at the patches of the antenna arrangement according to the invention at a second mode of operation.

Also with reference to FIG. 2*b*, as the outputs from the signal terminal $B_1$ is not phase shifted at all, this results in the first patch 2 being fed with equal amplitude, but with a phase difference of 180° at the opposite first 18 and second 19 feeding points.

This in turn results in a second E-field 39 directed essentially perpendicular to the main surfaces 4, 5: 6, 7 of the first 2 and second 3 patch in the circumferential slot 37 created between the edges 8, 9 of the first 2 and second 3 patch, respectively, having a sinusoidal variation all around the circumference of the first 2 and second 3 patch. The E-field 39 is shown in FIG. 2*b* as a number of arrows having a length that corresponds to the strength of the E-field, where the arrows indicate an instantaneous E-field distribution as it varies harmonically over time.

With reference to FIG. 1*a*, the third mode of operation corresponds to the second mode of operation, but here a signal is fed to the second difference terminal $\Delta_2$ of the second 90° 3 dB hybrid junction 30 via the second difference port 34. This results in that the first patch 2 is fed with equal amplitude but with a phase difference of 180° at the opposite third 20 and fourth 21 feeding points.

Figure 2C:
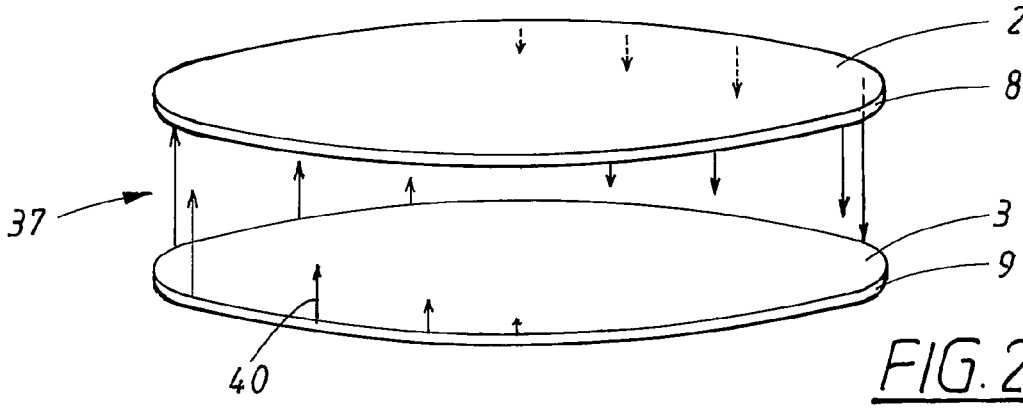
FIG. 2*c* shows a schematic simplified side view of the field distribution at the patches of the antenna arrangement according to the invention at a third mode of operation.

Also with reference to FIG. 2*c*, which for reasons of clarity shows the patches without the feeding arrangement, this in turn results in a third E-field 40 directed essentially perpendicular to the main surfaces 4, 5; 6, 7 of the first 2 and second 3 patches in the circumferential slot 37 created between the edges 8, 9 of the first 2 and second 3 patch, respectively, having a sinusoidal variation all around the circumference of the first 2 and second 3 patch. Using the same reference direction for the fields, if the second E-field 39 varies with sine, the third E-field 40 varies with cosine. This means that the third E-field 40 further is perpendicular to the second E-field 39, this will be explained more in detail later.

In the same way as for the second mode of operation, the third E-field 40 is shown in FIG. 2*c* as a number of arrows having a length that corresponds to the strength of the E-field, where the arrows indicate an instantaneous E-field distribution as it varies harmonically over time.

Thus, the triple-mode antenna arrangement 1 is now excited in three different ways, thus acquiring three different modes with a first 38, second 39 and third 40 E-field, constituting aperture fields which all ideally are orthogonal to each other.

The corresponding radiation patterns are also orthogonal, and the correlation equals zero, where the correlation ρ may be written as $$\rho = \frac{\oint_{\Omega} \vec{E}_1(\Omega)\vec{E}_2^*(\Omega)d\Omega}{\sqrt{\oint_{\Omega} |\vec{E}_1(\Omega)|^2 d\Omega \oint_{\Omega} |\vec{E}_2(\Omega)|^2 d\Omega}}$$

In the equation above, Ω represents a surface and the symbol * means that it is a complex conjugate. For the integration of the radiation pattern, Ω represents a closed surface comprising all space angels, and when this integration equals zero, there is no correlation between the radiation patterns, i.e. the radiation patterns are orthogonal to each other. The denominator is an effect normalization term.

When determining that the radiation patterns are orthogonal, it is possible to use the aperture fields. When considering the aperture fields, Ω represents an aperture surface. The aperture fields between the edges 8, 9 are orthogonal since the integration of a constant (the first mode) times a sinusoidal variation (second or third mode) over one period equals zero. Further, the integration of two orthogonal sinusoidal variations, sine*cosine, (the second and third mode) over one period also equals zero. As these fields 38, 39, 40 are orthogonal at the aperture of the antenna arrangement 1 and correspond to aperture currents (not shown) of the antenna 1, which aperture currents then also are orthogonal, the far-field also comprises orthogonal field vectors, as known to those skilled in the art.

Having three, at least essentially, orthogonal radiation patterns is desirable, since this enables the rows in the channel matrix to be independent. This in turn means that the present invention is applicable for the MIMO system.

By means of superposition, all modes of operation may be operating at the same time, thus allowing the triple-mode antenna arrangement to transmit three essentially orthogonal radiation patterns.

The actual implementation of the feeding arrangement is not important, but may vary in ways which are obvious for the skilled person. The important feature of the present invention is that the patches 2, 3 are fed in three modes of operation, where the first mode of operation results in an E-field 38 being acquired at the circumferential slot 38 between the first 2 and second 3 patch. The other modes of operation result in two E-fields 39, 40 which have sine variations of the field strength being acquired at the circumferential slot 37 between the first 2 and second 3 patch, where one of these E-fields is rotated 90° with respect to the other. This function is not limited by the design of the feeding arrangement or how the feeding points 18, 19, 20, 21 are conceived. They may for example obtain electrical connection in a contactless manner, i.e. by means of capacitive coupling as known in the art.

Due to reciprocity, for the transmitting properties of the triple-mode antenna arrangement 1 described, there are corresponding equal receiving properties, as known to those skilled in the art, allowing the triple-mode antenna arrangement to both send and receive in three essentially uncorrelated modes of operation.

The invention is not limited to the embodiments described above, which only should be regarded as examples of the present invention, but may vary freely within the scope of the appended claims.

Other types of patches may be conceivable, instead of those described. For example, the patches may have other shapes, for example square, rectangular or octagonal. The three patches may also have different shapes between themselves, i.e. the first patch may be octagonal, the second patch square etc. The patches may be made in any appropriate conducting material, for example copper, aluminium, silver or gold. The patches may further be made from thin metal sheets and separated by air only, held in place by means of appropriate retainers (not shown). Alternatively, the patches may be etched from copper-clad laminates.

Any kind of feeding of the patches is within the scope of the invention, where different kinds of probe feed are the most preferred. The capacitive probe feed mentioned above is such an alternative.

The distance d between the first imagined line and the respective feeding points does not have to be the same for every feeding point, but may vary if appropriate. The positioning of the feeding points is determined by which impedance that is desired. In other words, the distance d is generally varied in order to obtain a desired impedance matching.

The first imagined line does not have to pass through a central area of the patches, but may pass the patches wherever appropriate.

The feed network may further be implemented in many different ways, which ways are obvious for the person skilled in the art. The patches may be fed in such a way that other mutually orthogonal polarizations may be obtained, for example right-hand circular polarization and/or left-hand circular polarization.

The invention claimed is:

1. An antenna arrangement comprising:

first and second planar parallel antenna patches; and a feeding mechanism comprising first, second, third, and fourth feeding lines for electrically feeding the first antenna patch, wherein each feeding line is connected to the first antenna patch at feeding points angularly offset by 90 degrees from adjacent feeding points, wherein the first and second feeding points are offset by 180 degrees and the third and fourth feeding points are offset by 180 degrees such that the clockwise order of the succeeding feeding points is the first, the third, the second, and the fourth;

wherein when all of the feeding lines are fed essentially in phase, a first constant E-field is generated in a slot between the edges of the first and second antenna patches;

wherein when the first and second feeding lines are fed 180 degrees out of phase with each other, a second, sinusoidally varying E-field is generated in the slot between the edges of the first and second antenna patches; and wherein when the third and fourth feeding lines are fed 180 degrees out of phase with each other, a third, sinusoidally varying E-field is generated in the slot between the edges of the first and second antenna patches, said third sinusoidally varying E-field being rotated 90 degrees with respect to the second sinusoidally varying E-field.

2. An antenna arrangement comprising:

a first and a second antenna patch, each patch constructed of a conducting material and having an upper and a lower main surface, said patches being placed one above the other with the first patch on top such that all of the main surfaces are parallel to each other, wherein the first patch has a first edge and the second patch has a second edge;

a feeding arrangement comprising a first, second, third, and fourth feeding point feeding the first antenna patch, in transmission as well as in reception, wherein each feeding point is positioned at a distance (d) from a reference point on the first patch, and the four feeding points are arranged around the reference point at approximately 90-degree increments with the first and second feeding points being arranged on a straight line through the reference point and on opposite sides of the reference point, and the third and fourth feeding points being arranged on a straight line through the reference point and on opposite sides of the reference point, wherein the clockwise order of the succeeding feeding points is the first, the third, the second, and the fourth;

wherein, in a first mode of operation, each one of the feeding points are fed essentially in phase with each other, resulting in a first constant E-field being generated in a slot formed between the edges of the first and second antenna patches;

wherein, in a second mode of operation, the first and the second feeding points are fed 180 degrees out of phase with each other, resulting in a second E-field being generated in the slot, the second E-field being directed between the edges of the first and second antenna patches and having a first sinusoidal variation along the slot; and wherein, in a third mode of operation, the third and the fourth feeding points are fed 180 degrees out of phase with each other, resulting in a third E-field being generated in the slot, the third E-field being directed between the edges of the first and second antenna patches and having a second, different, sinusoidal variation along the slot.

3. The antenna arrangement according to claim 2, wherein the arrangement operates in the three modes of operation at the same time.

4. The antenna arrangement according to claim 2, wherein the first and second feeding points are fed with such phases, with respect to the third and fourth feeding points, that the second and third E-fields are essentially orthogonal to each other.

5. The antenna arrangement according to claim 2, wherein the feeding arrangement also includes a first and a second four-port, 90-degree, 3-dB hybrid junction and a first and a second 90-degree phase-shifter;

wherein the first hybrid junction comprises a difference terminal $\Delta_1$, a sum terminal $\Sigma_1$ and two signal terminals $A_1$ and $B_1$, and the second hybrid junction comprises a difference terminal $\Delta_2$, a sum terminal $\Sigma_2$ and two signal terminals $A_2$ and $B_2$;

wherein the sum terminals $\Sigma_1$ and $\Sigma_2$ are connected to a common sum signal at a sum connection point; and wherein:

the signal terminal A1 is connected to the first feeding point through a first coaxial feed line, via the first 90-degree phase shifter;

the signal terminal A2 is connected to the third feeding point through a third coaxial feed line, via the second 90-degree phase shifter;

the signal terminal B1 is connected to the second feeding point through a second coaxial feed line; and the signal terminal B2 is connected to the fourth feeding point through a fourth coaxial feed line.

6. The antenna arrangement according to claim 5, wherein all of the coaxial feed lines are of equal length.

7. The antenna arrangement according to claim 2, wherein the antenna patches are symmetrical around the reference point.

8. The antenna arrangement according to claim 7, wherein the first and second antenna patches are essentially circular.

9. The antenna arrangement according to claim 2, wherein the first and second antenna patches have essentially the same shape.

10. The antenna arrangement according to claim 2, wherein the distances (d) between the reference point and the respective feeding points of the first antenna patch are essentially equal.

* * * * *

UNITED STATES PATENT AND TRADEMARK OFFICE

CERTIFICATE OF CORRECTION

PATENT NO. : 7,460,071 B2
APPLICATION NO. : 11/722913
DATED : December 2, 2008
INVENTOR(S) : Manholm et al.

It is certified that error appears in the above-identified patent and that said Letters Patent is hereby corrected as shown below:

In Column 4, Line 10, delete "2," and insert -- 3, --, therefor.

In Column 8, Line 62, in Claim 5, delete "A1" and insert -- $A_1$ --, therefor.

In Column 8, Line 65, in Claim 5, delete "A2" and insert -- $A_2$ --, therefor.

In Column 9, Line 1, in Claim 5, delete "B1" and insert -- $B_1$ --, therefor.

In Column 9, Line 3, in Claim 5, delete "B2" and insert -- $B_2$ --, therefor.

Signed and Sealed this

Twenty-first Day of April, 2009

John Doll

JOHN DOLL
*Acting Director of the United States Patent and Trademark Office*